United States Patent [19]

Philips

[11] 4,361,264

[45] Nov. 30, 1982

[54] PARTITION STRUCTURE

[75] Inventor: Nicholas A. Philips, Glendale Heights, Ill.

[73] Assignee: Container Corporation of America, Chicago, Ill.

[21] Appl. No.: 257,535

[22] Filed: Apr. 27, 1981

[51] Int. Cl.[3] ..... B65D 5/48

[52] U.S. Cl. ..... 229/15; 229/28 R

[58] Field of Search ..... 229/15, 42, 27, 28 R

[56] References Cited

U.S. PATENT DOCUMENTS

| | | | |
|---|---|---|---|
| 1,306,796 | 6/1919 | Boswell | 229/15 |
| 1,636,508 | 7/1927 | Gandyan | 229/15 |
| 1,704,948 | 3/1929 | Maston | 229/15 |
| 2,034,679 | 3/1936 | Kundts | 229/27 |
| 2,527,221 | 10/1950 | Huye | 229/15 |
| 2,593,092 | 4/1952 | Beegstein | 229/15 |
| 2,778,522 | 1/1957 | Becke | 229/15 |
| 3,301,460 | 1/1967 | Harrison | 229/15 |
| 3,348,667 | 10/1967 | Beeby | 229/15 |
| 3,628,718 | 12/1971 | Boyler | 229/15 |
| 3,770,184 | 11/1973 | Rockefeller | 229/15 |
| 3,931,924 | 1/1976 | Gardner | 229/15 |
| 3,985,286 | 10/1976 | Hicks | 229/15 |
| 4,096,984 | 6/1978 | Gardner | 229/15 |
| 4,164,312 | 8/1979 | Harned | 229/15 |
| 4,272,008 | 6/1981 | Woyniacki | 229/15 |

*Primary Examiner*—Herbert F. Ross

*Attorney, Agent, or Firm*—Richard W. Carpenter; Davis Chin

[57] ABSTRACT

A partition structure is formed from a transversely scored blank joined at its ends to define a tube, the tube having central planar portions movable normally to each other into contact, ends of the blank being foldable along score lines to define end segments extending from the planes of said planar portions.

4 Claims, 8 Drawing Figures

PARTITION STRUCTURE

BACKGROUND OF THE INVENTION

1. Field of the Invention

The invention relates to improvements in container partitions and particularly to one having two plies of board material joined at its ends by a single manufacturer's joint to form a tube having central planar portions movable against each other, which in so doing form end segments extending from the central planar portions.

2. Description of the Prior Art

An extensive search of the prior art developed the following U.S. Pat. Nos.:

La Fleur, 621,609;
Maston, 1,704,948;
DePasquale, 3,139,229;
Foley, 3,260,440;
Rockefeller, 3,770,184;
Snyder, 4,094,454;
Harned, 4,164,312.

None of the above patents teaches a partition formed from a tube having a single manufacturer's joint, where the formed tube has central planar portions movable normally against each other and in so doing forming end segments extending from the central planar portions.

SUMMARY OF THE INVENTION

The invention structure is formed from a tube having transversely extending fold lines defining partition portions joined by a single manufacturer's joint, central panel portions being movable toward each other to cause end segments to extend transversely from the planes of the planar portions.

DESCRIPTION OF INVENTION EMBODIMENTS

Figure 2:
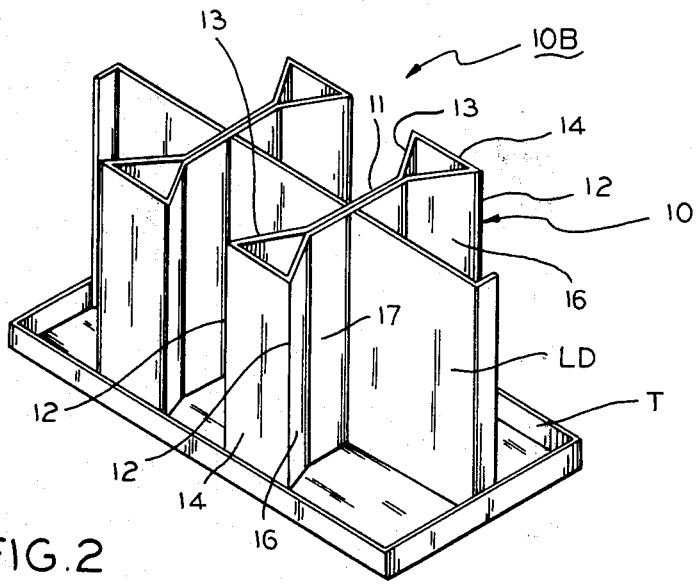
FIG. 2 is an isometric view showing the blank of FIG. 1 erected and in position on a packaging tray.

Referring now to FIGS. 1 to 6 of the drawings, there is shown an embodiment of the invention denoted by the reference numeral 10 and formed from a cut and scored blank 10A of paperboard or the like. The invention structure is shown in FIG. 2 in the environment of a packaging concept 10B having a longitudinal divider LD with the structures 10 in interdigitating relationship therewith to form a plurality of compartments as seen. The concept 10B rests upon a tray T, or it may be enclosed within a shipping container, not shown.

Blank 10A has a central planar portion 11 flanked to each side by segments 13, 14 and 16, these being connected together along parallel fold lines 12 and to planar portion 11 by a similar spaced parallel fold line 12.

One end of blank 10A is provided with a glue flap 17 foldably connected to one of the segments 16 along a fold line 12, and the other end of blank 10A is provided with an opposite central planar portion 18 foldably connected to the other segment 16 along a fold line 12.

Glue flap 17 is folded with respect to fold line 12, and panel portion 18 is folded with respect to its fold line 12, flap 17 overlying panel portion 18 and being glued thereto.

The panel portions 11 and 18 are now in overlying-/underlying relationship, and each has a slit 9 therein enabling the structure to lock with longitudinal divider LD.

Figure 1:
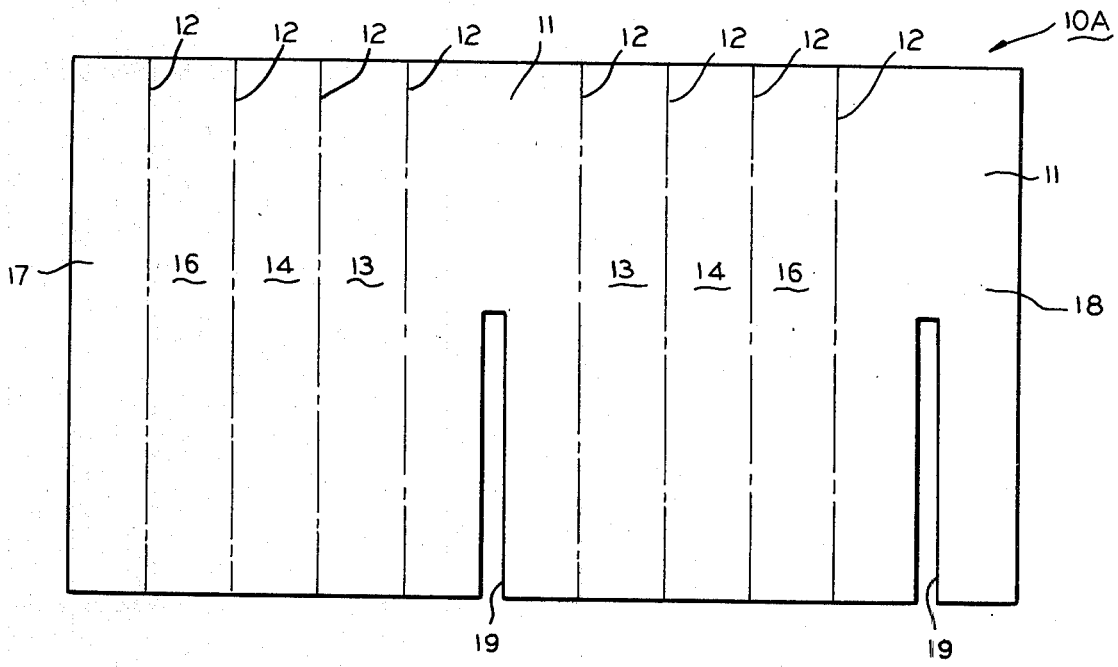
FIG. 1 is a plan view of a cut and scored blank for forming the partition according to the present invention.
Figure 3:
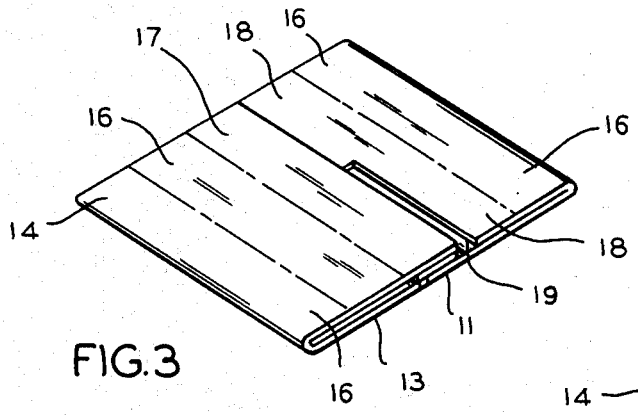
FIG. 3 is an isometric view showing the blank of FIG. 1 folded and glued.
Figure 4:
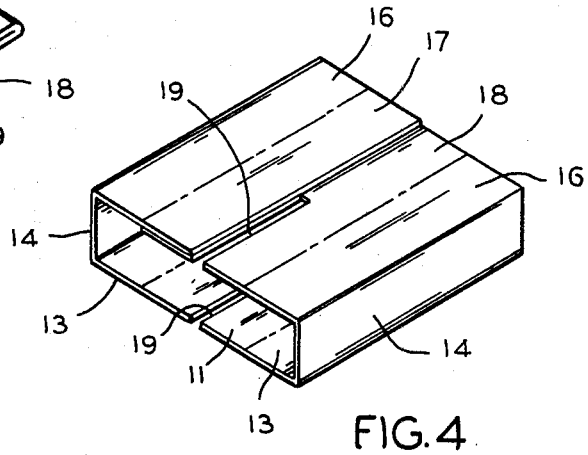
FIG. 4 is an isometric view showing the blank of FIG. 3 erected to define a tube.

As seen in FIG. 4, the folded and glued blank of FIG. 3 can be erected into a tube. It will be noted that the fold lines 12 flanking the central portion 11 are spaced from the fold lines 12 of central portion 18 and are aligned.

Figure 5:
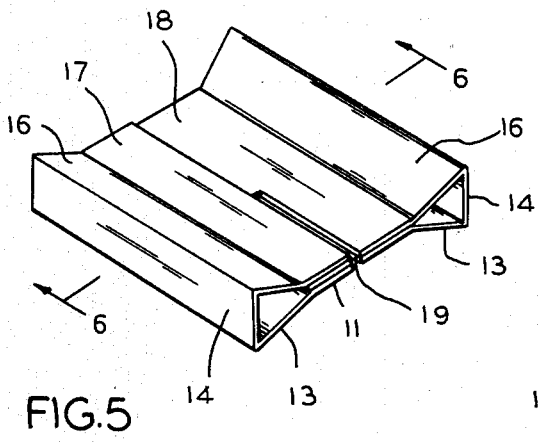
FIG. 5 is an isometric view showing the tube of FIG. 4 shaped to define a partition structure.
Figure 6:
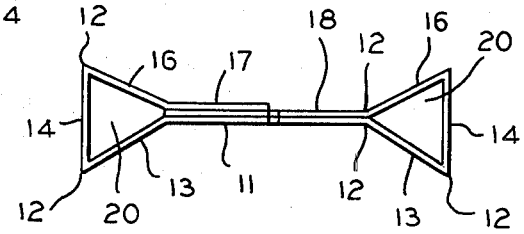
FIG. 6 is a sectional view taken along the line 6—6 of FIG. 5 looking in the direction of the arrows.

As seen in FIG. 5 the central panel portions 11 and 18 can be moved normally to each other into contact with the fold lines in alignment. At such time the segments 14 and 16 adopt the positions seen FIGS. 5 and 6 to provide at each end of structure 10 a cell 20 of triangular cross section.

When the panel elements 11 and 18 are moved into contacting relationship, the slots 19 are in register, and they intersect with slots, not shown, in longitudinal divider LD as seen in FIG. 2, the structures 10 adopting the position seen in said figure.

Figure 7:
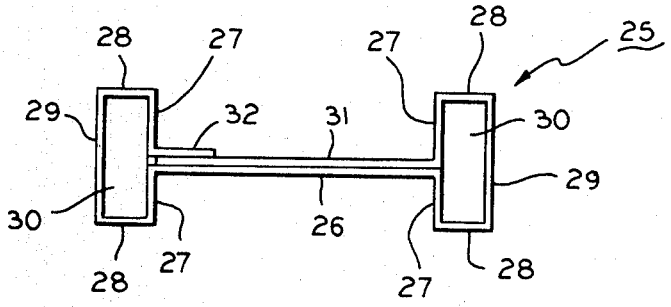
FIG. 7 is a sectional view taken through a partition structure of a varriant form.

Referring now to FIG. 7, there is shown another embodiment referred to by reference numeral 25. In this embodiment the structure is formed from a cut and scored blank with contacting central planar portions 26 and 31. These are part of a tube by reason of a glue flap 32, and the planar portions 26 and 31 are foldably connected to segments 27, 28 and 29, all foldably connected, which upon normal movement of portions 26 and 31 form rectangular cross section cells 30.

Figure 8:
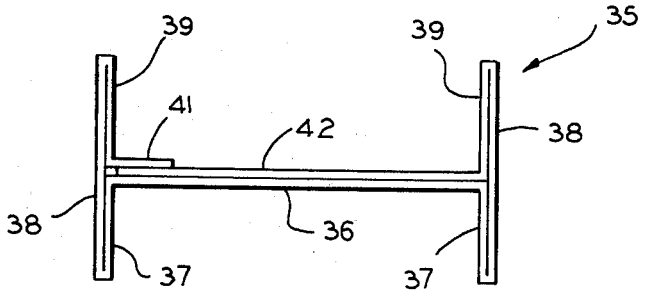
FIG. 8 is a sectional view of another variant form.

In a similar fashion, and as seen in FIG. 8, another embodiment is referred to by reference numeral 35. As with the embodiment of FIGS. 1 and 2, there are provided portions 36 and 42 movable toward each other into contacting relationship. A glue flap 41 connects portions 36 and 42 which together with segments 37, 38 and 39 define a tube which is collapsible in the same fashion as the tube of FIG. 4.

In this embodiment elements 37 and 39 close against element 38.

I claim:

1. A partition structure adapted for use in dividing a container into compartments, said partition structure being formed from a blank of paperboard and comprising:

a first central planar portion;

a first end portion formed of three congruent segments joined in series on transverse parallel fold lines, one end of said first end portion being connected to one end of said first central planar portion;

a second end portion formed of three congruent segments joined in series on transverse parallel fold lines, one end of said second end portion being connected to the other end of said first central planar portion;

a glue flap foldably joined to the other end of said first end portion;

a second central planar portion foldably joined to the other end of said second end portion;

said first and second central planar portions being of the same dimensions and at least twice the length of said segment;

said glue flap overlying said second central planar portion and being glued thereto to form a tube;

said transverse parallel fold lines on opposite sides of said tube being spaced from each other in a parallel relationship; and said first and second central planar portions of said tube being movable in contacting engagement and providing said first and second end portions to extend transversely from the planes of said planar portions.

2. A partition structure as claimed in claim 1, wherein said first and second end portions are formed with a triangular cross section.

3. A partition structure as claimed in claim 1, wherein said first and second end portions are formed with a rectangular cross section.

4. A partion structure as claimed in claim 1, wherein one of the three segments of said first and second end portions extends transversely to said first and second central planar portions, and wherein the other segments of said first and second end portions are disposed in face-to-face contacting relation with said one segment.

* * * * *